United States Patent [19]

Ausman

[11] 4,215,621

[45] Aug. 5, 1980

[54] TARGET MARKER PLACEMENT FOR DIVE-TOSS DELIVERIES WITH WINGS NONLEVEL

[75] Inventor: John S. Ausman, Woodland Hills, Calif.

[73] Assignee: Litton Systems, Inc., Beverly Hills, Calif.

[21] Appl. No.: 967,329

[22] Filed: Dec. 7, 1978

[51] Int. Cl.[3] ..... B64D 1/04

[52] U.S. Cl. ..... 89/1.5 E; 235/402

[58] Field of Search ..... 89/1.5 R, 1.5 E, 1.5 S; 235/402, 401

[56] References Cited

U.S. PATENT DOCUMENTS

| | | | |
|---|---|---|---|
| 2,985,365 | 5/1961 | Helgeson et al. | 235/402 |
| 2,995,984 | 8/1961 | Helgeson et al. | 89/1.5 E |
| 3,003,398 | 10/1961 | Lalli | 89/1.5 E |
| 3,091,993 | 6/1963 | Brink et al. | 89/1.5 E |
| 3,474,704 | 10/1969 | Faxén et al. | 235/402 X |
| 3,689,741 | 9/1972 | Sjöberg et al. | 235/402 |
| 3,880,043 | 4/1975 | Cox et al. | 89/1.5 E |
| 3,995,144 | 11/1976 | Johnson et al. | 89/1.5 E X |

*Primary Examiner*—David H. Brown

*Attorney, Agent, or Firm*—H. E. Gillmann; Roy L. Brown

[57] ABSTRACT

An apparatus for positioning the target marker in a toss-bombing display to allow toss-bombing when the wings of the bombing aircraft are not level.

4 Claims, 6 Drawing Figures

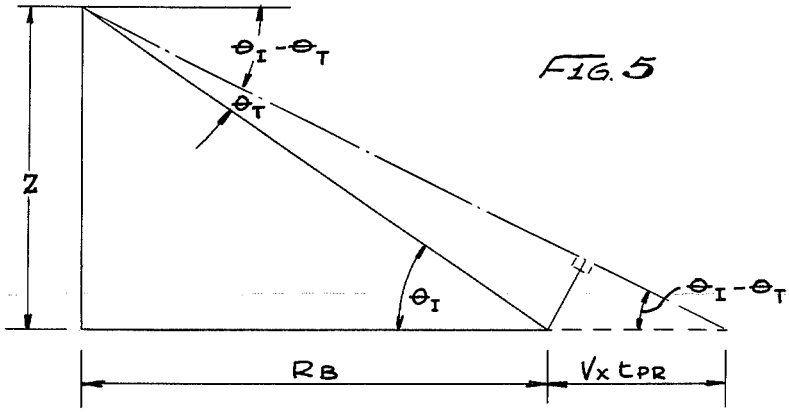
FIG. 5
FIG. 6
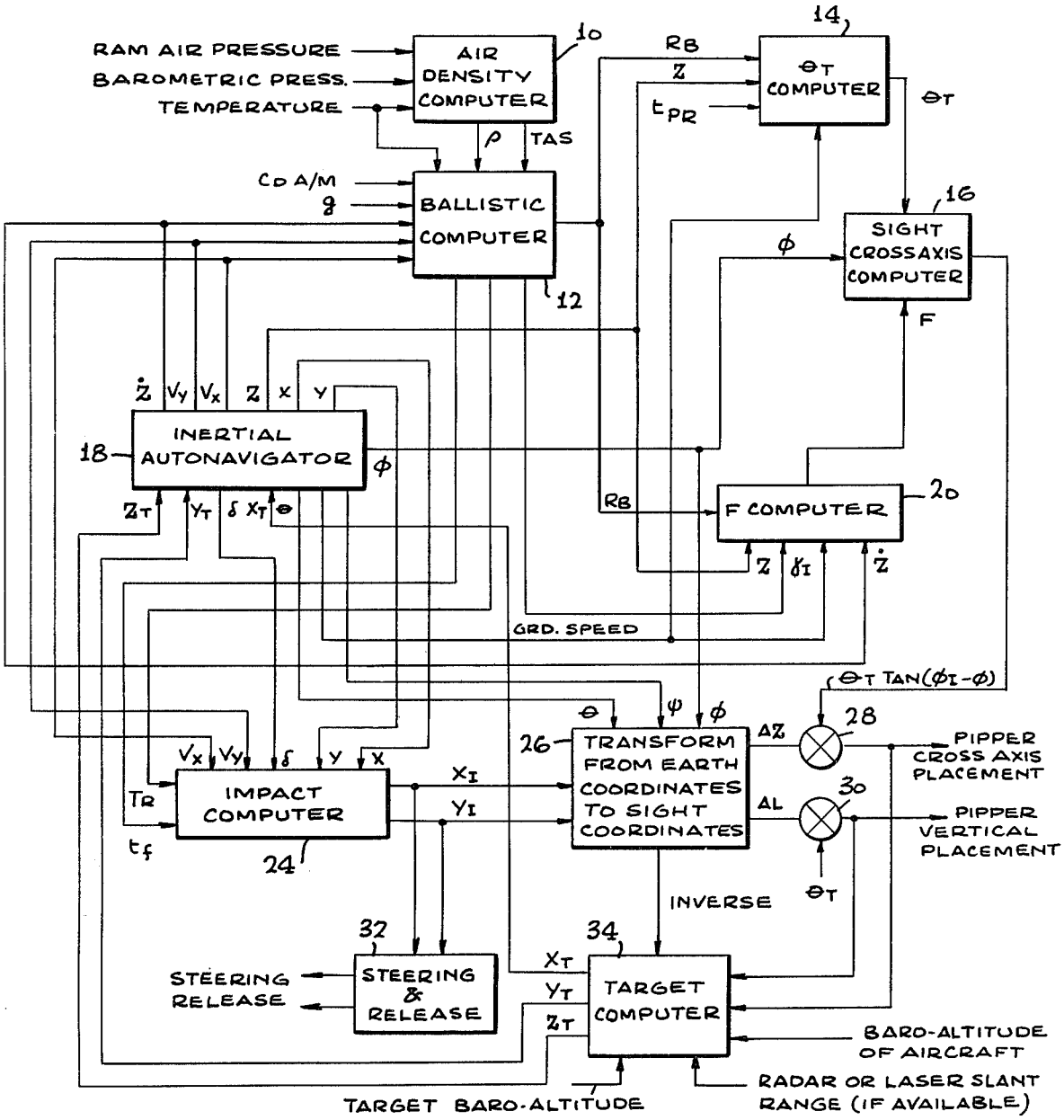

TARGET MARKER PLACEMENT FOR DIVE-TOSS DELIVERIES WITH WINGS NONLEVEL

BACKGROUND OF THE INVENTION

Most computerized air-to-ground weapon delivery systems have at least two delivery modes. One is manual release or continuously computed impact point (CCIP) mode. The other is an automatic release mode, also referred to as dive-toss or continuously computed release point (CCRP).

In the manual or CCIP mode, the computer displays the resulting impact point if weapon release were to occur at the present time. The pilot steers the aircraft so as to overlay the target with this impact point symbol. He then depresses the weapon release button which manually triggers the weapon release.

In the dive-toss or automatic mode, the computer displays a target marker symbol or pipper which is elevated above the computed impact point. This elevation or lead angle is necessary so that the target marker symbol will pass the target in advance of the release time. The pilot steers the aircraft so as to overlay the target with the pipper and then depresses a "target designation" or "pickle" switch. This action signals the computer to record all available target sensor information such as the line-of-sight azimuth and depression angles, slant range, and altitude. From these data the computer calculates the target location and generates steering signals which direct the pilot to steer the computed impact pilot toward the target. As the computed impact point crosses the computed target position, the computer automatically issues a weapon release signal.

The term "dive-toss" as applied to this delivery mode comes about because the pilot, after designating the target in a dive, usually pulls back hard on the control stick to initiate a high g pullup. By this pullup maneuver the pilot gets rid of the bomb as soon as possible. He can then initiate evasive action to avoid antiaircraft fire.

If the pipper position is short of the computed impact point (negative lead angle), the aircraft would already be past the release point when the pilot designated the target. On the other hand, if the pipper position is above the horizon, the pilot cannot position it over the target, which is presumably on the ground. By this line of reasoning, the weapon delivery system must position the target marker somewhere between the impact point and the horizon.

Some currently operational weapon delivery systems set the elevation coordinate of the target marker to zero depression. Others match the depression angle of the target marker to that of the aircraft's velocity vector. As for the azimuth coordinate, most of these current systems employ a drift stabilized sight. That is, the target marker symbol lies in the azimuthal plane of the aircraft's ground velocity vector.

The effect of drift-stabilizing the sight is to place the target marker symbol in the path of the computed impact point (neglecting cross trail) provided the aircraft's ground velocity does not change direction between pickle and release. In other words, the steering signals generated by the computer, after the pilot designates the target, will call for wings level flight. The pilot can still pull up, but he must do so with wings level.

Because the pilot is usually working very hard to steer the target marker symbol over the target, the aircraft is often in a bank at the time of target designation. In such a case the pilot must first unroll to a wings level attitude before initiating his pullup maneuver. The natural tendency of a pilot, however, is to pull straight back on the stick after designating the target, ignoring the wings level steering commands.

BRIEF DESCRIPTION OF THE INVENTION

The cause of this mismatch between system operation and the pilot's instinctive reaction is the system design decision to drift-stabilize the sight. The system designer, according to this invention, achieves a better match between pilot and system by having the system anticipate the wings nonlevel pullup and positioning the target marker accordingly. Such anticipation is achieved, for example, by positioning the target marker to the left of the aircraft velocity vector when the aircraft is in a bank to the left, and to the right of the aircraft velocity vector when the aircraft is in a bank to the right.

The left-right displacement of the target marker as a function of roll angle provides an auxiliary benefit which may prove to be more significant than the elimination of the wings level pullup requirement. This feature gives the pilot direct control of the left-right motion of the target symbol. He simply has to roll the aircraft left or right. The sight marker moves accordingly, and the response is immediate. This greatly simplifies the pilot's task of steering the target marker onto the target, and hence results in better aiming (closer coincidence of target and target marker symbol at time of target designation) by the pilot and more accurate weapon deliveries.

To better appreciate the advantage of this direct control of the sight reticle, consider the aiming task of the pilot when using a drift stabilized sight. The pilot must move the velocity vector of the aircraft to move the target marker. The velocity vector, however, is one integral removed, in a dynamic sense, from the attitude of the aircraft, which is what the pilot controls. Consequently, the velocity vector and the target marker lag the pilot's control actions, and it takes a considerable degree of pilot skill and training to steer the target marker into coincidence with the target.

To avoid the necessity of a wings-level attitude, the target marker symbol, in a dive-toss weapon delivery mode, is moved laterally across the sight in response to the roll attitude of the delivery aircraft.

It is therefore an object of this invention to place a target marker or reticle on a target.

It is a more specific object to place the target marker or reticle on a target for a dive-toss or continuously computed release point mode of bombing.

It is still a more specific object of the invention to displace the target marker or reticle right and left in response to the roll angle of the bombing aircraft.

It is yet a more specific object of the invention to avoid the need for a wings level attitude of the bombing aircraft in a pullup during a dive-toss bomb delivery mode.

It is also a more specific object of the invention to facilitate target designation by the pilot of a bombing aircraft.

Other objects will become apparent from the following description, taken together with the accompanying drawings, in which:

BRIEF DESCRIPTION OF THE DRAWINGS

FIG. 5 is a diagram of aircraft and target position; and FIG. 6 is a block diagram of a computer usable to produce the sighting signals of this invention.

DETAILED DESCRIPTION OF THE INVENTION

Figure 1:
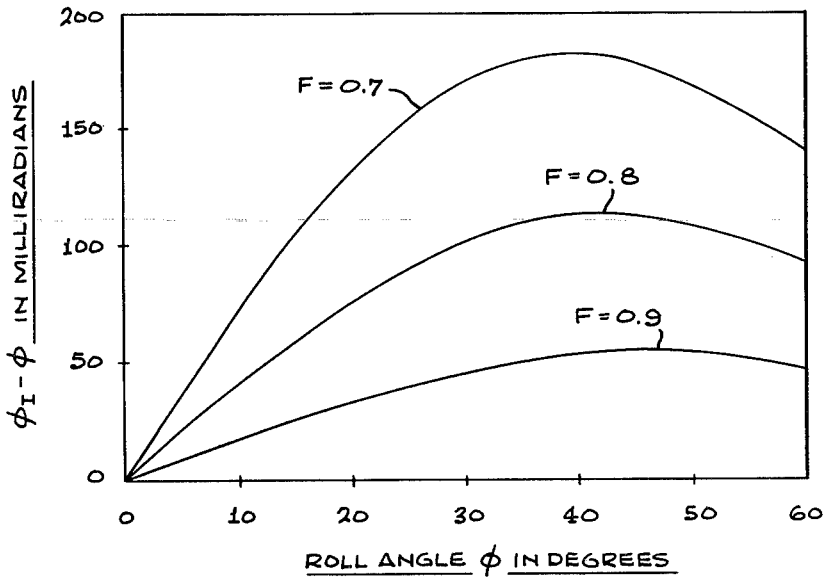
FIG. 1 is a plot of $\phi_I$-$\phi$ against roll angle for various values of F.

It is first desirable to determine the relationship between aircraft acceleration and the apparent motion of the impact point on the signt or heads-up display against the target background. Equation (1) is the general impact equation which expresses the position ($X_I$, $Y_I$) of the bomb's impact point in terms of the position (X, Y) and ground velocity ($V_x$, $V_y$) of the bomb at release.

$$X_I = X + V_x t_f - T_R \cos\delta \qquad (1)$$

$$Y_I = Y + V_y t_f - T_R \sin\delta$$

where $t_f$ is the time-of-fall (release to impact), $T_R$ is the bomb trail, and $\delta$ is the drift angle between the X-axis and the horizontal component of the weapon's airspeed vector at computed release.

First differentiate Equation (1) with respect to time to obtain a relationship between the impact point motion, $\dot{X}_I$ and $\dot{Y}_I$, and the aircraft acceleration. It greatly simplifies the analysis to neglect the $T_R$ terms, in effect restricting the analysis to the zero drag case. This is not so restrictive as it might seem at first, because the dive-toss mode is usually employed with low drag bombs, and such bombs approximate a zero drag bomb reasonably well. Furthermore, the purpose of this analysis is to determine the most convenient placement of the target designating pipper. If, due to approximations in the analysis, the pipper location is not quite in line with the impact point motion as the pilot pulls up, the computer commands a small compensatory steering correction. If the pilot follows this steering command he avoids the bombing error which otherwise would have occurred.

Neglecting $T_R$ in Equation (1) based on the foregoing rationale, differentiate Equation (1) with respect to time as follows:

$$\left.\begin{aligned} \dot{X}_I &= V_x + \dot{V}_x t_f + V_x \dot{t}_f \\ \dot{Y}_I &= V_y + \dot{V}_y t_f + V_y \dot{t}_f \end{aligned}\right\} \qquad (2)$$

By definition, the cross track velocity $V_y$ is zero at the target designation point. At this time, Equation (2) reduces to $$\left.\begin{aligned} \dot{X}_I &= V_x + \dot{V}_x t_f + V_x \dot{t}_f \text{ (down track)} \\ \dot{Y}_I &= \dot{V}_y t_f \qquad\qquad \text{(cross track)} \end{aligned}\right\} \qquad (3)$$

Equation (3) shows that, at target designation time, the cross track velocity of the computed impact point is directly proportional to cross track acceleration with $t_f$ being the constant of proportionality. Further reduction of the along track impact motion equation requires an expression for $\dot{t}_f$. For the zero drag bomb approximation, the time-of-fall is a function only of altitude above target and vertical velocity. Hence, $$\dot{t}_f = \frac{\delta t_f}{\delta Z}\dot{Z} + \frac{\delta t_f}{\delta V_z}\dot{V}_z = -\frac{\delta t_f}{\delta Z}V_z + \frac{\delta t_f}{\delta V_z}\dot{V}_z \qquad (4)$$

The partial derivatives $\partial t_f/\partial Z$ and $\partial t_f/\partial V_Z$ are espressed analytically (for a zero drag bomb) as follows:

$$\frac{\delta t_f}{\delta Z} = \frac{1}{\sqrt{V_x^2 \pm 2gZ}} = \frac{1}{V_{zI}} \qquad (5)$$

$$\frac{\delta t_f}{\delta V_z} = \frac{1}{V_{zI}}\left(\frac{V_z - V_{zI}}{g}\right) = \frac{-t_f}{V_{zI}} \qquad (6)$$

where Z is the altitude of the bombing aircraft at the computed time of release, $V_{zI} = V_z + gt_f = \sqrt{V_z^2 + 2gZ}$ is the downward component weapon velocity at computed impact, and g is the acceleration of gravity. Substituting Equations (5) and (6) into Equation (4) gives $$\dot{t}_f = -\frac{(V_z + t_f\dot{V}_z)}{V_{zI}} \qquad (7)$$

In a constant speed, coordinated maneuver the along track, cross track, and vertical accelerations are all related to the aircraft's normal acceleration, $A_N$, as follows:

$$\dot{V}_x = A_N \cos\phi \sin\gamma \qquad (8)$$

$$\dot{V}_y = A_N \sin\phi$$

$$\dot{V}_z = A_N \cos\phi \cos\gamma + g$$

Where $\phi$ is the aircraft roll angle (right wing down is positive), and $\gamma$ is the angle between the weapon's velocity vector and the horizontal plane (positive in a dive) at the computed release point. Substitution of Equations (7) and (8) into Equation (3) and use of the identity, $V_z + gt = V_{zI}$, yields $$\left.\begin{aligned} \dot{X}_I &= V_x + A_N t_f \cos\phi \sin\gamma - \frac{V_x V_z}{V_{zI}} + \frac{V_x t_f}{V_{zI}}(A_N \cos\phi \cos\gamma - g) \\ \dot{X}_I &= A_N t_f \cos\phi\,(\sin\gamma + \cos\gamma \operatorname{ctn}\gamma_I) \text{ (down track)} \\ \dot{Y}_I &= A_N t_f \sin\phi \qquad\qquad \text{(cross track)} \end{aligned}\right\} \qquad (9)$$

where $X_I$ is the down track coordinate of the computed impact point, $Y_I$ is the cross track coordinate of the computed impact point, $\gamma_I$ is the flight path angle of the weapon at the computed impact point and $\operatorname{ctn}\gamma_I = V_x/V_{zI}$ and represents the slope of the (computed) impact trajectory with respect to the vertical.

The apparent down track motion $\dot{X}_I$ in the plane of the sight will appear to be foreshortened by the sine of the depression angle $\theta_I$ to the computed impact point. Hence the tangent of the direction $\phi_I$ of apparent motion of the impact point in the sight plane is $$\tan\phi_I = \frac{\dot{Y}_I}{\dot{X}_I \sin\theta_I} = \frac{\tan\phi}{F} \qquad (10)$$

where $F = \sin\theta_I \cos\gamma(\tan\gamma + \operatorname{ctn}\gamma_I)$. (11)

Figure 2:
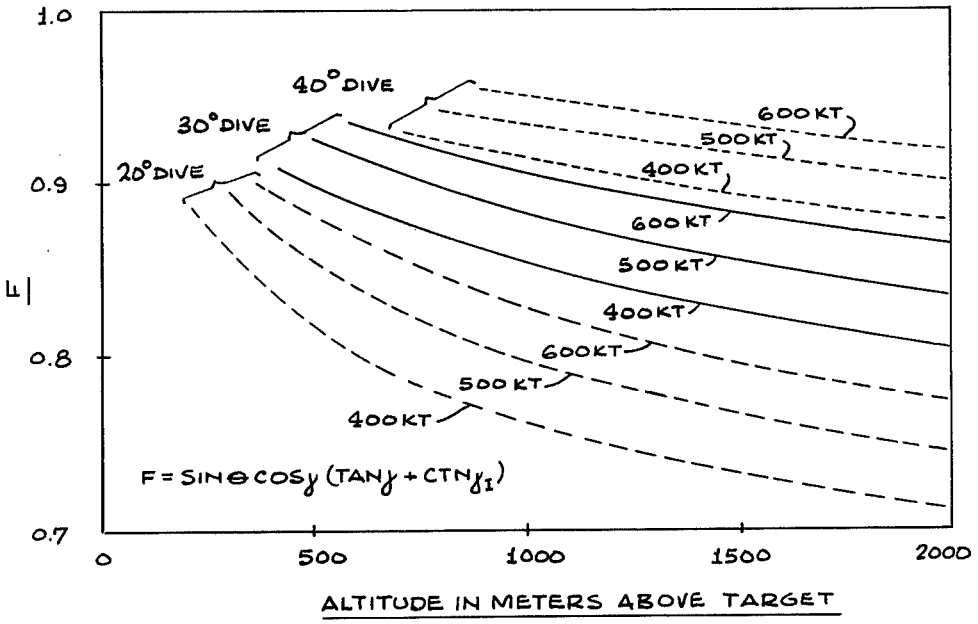
FIG. 2 is a plot of F against altitude for various speeds and dive angles.

A plot of F against altitude above the target, for various bomber speeds is shown in FIG. 2. If the quantity F in the denominator of Equation (10) were equal to unity, then tan $\phi_I$ would equal tan $\phi$, and the apparent motion of the impact point would be "straight up the sight," parallel to the ordinate or normal axis of the sight. Actually, the quantity F is always less than unity for any dive angle less than 90 degrees. Because F is less than unity, Equation (10) tells that the angle $\phi_I$ is greater than the angle $\phi$. This means that the impact point tracks off at an angle slightly to the right of the sight's ordinate axis in a right-hand bank or slightly to the left of that axis in a left-hand bank of the bomber. Equation (11) expresses the amount of this angular deviation mathematically.

$$\tan(\phi_I - \phi) = \frac{\tan\phi_I - \tan\phi}{1 + \tan\phi_I \tan\phi} \tag{12}$$

Using Equation (10) to eliminate tan $\phi_I$ from the right-hand side of Equation (12).

$$\tan(\phi_I - \phi) = \frac{\left(\frac{1}{F} - 1\right)\tan\phi}{1 + \frac{1}{F}\tan^2\phi} \tag{13}$$

$$\tan(\phi_I - \phi) = \frac{(1 - F)\tan\phi}{F + \tan^2\phi} \tag{14}$$

Equation (14) describes the track or direction of motion of the computed impact point across the sight during a banked but coordinated turning pullup. FIG. 1 is a graphical plot of Equation (14) for several values of the quantity F. FIG. 2 shows the quantity F plotted for various dive angles altitudes and air speeds. This figure indicates that $0.70<F<0.95$ for dive angles of 20 to 40 degrees, air speeds between 400 and 600 kts, and altitudes up to 2000 m. Because F is generally greater than 0.70, $\phi_I$-$\phi$ is generally less than 10 deg (175 milliradians).

Figure 3:
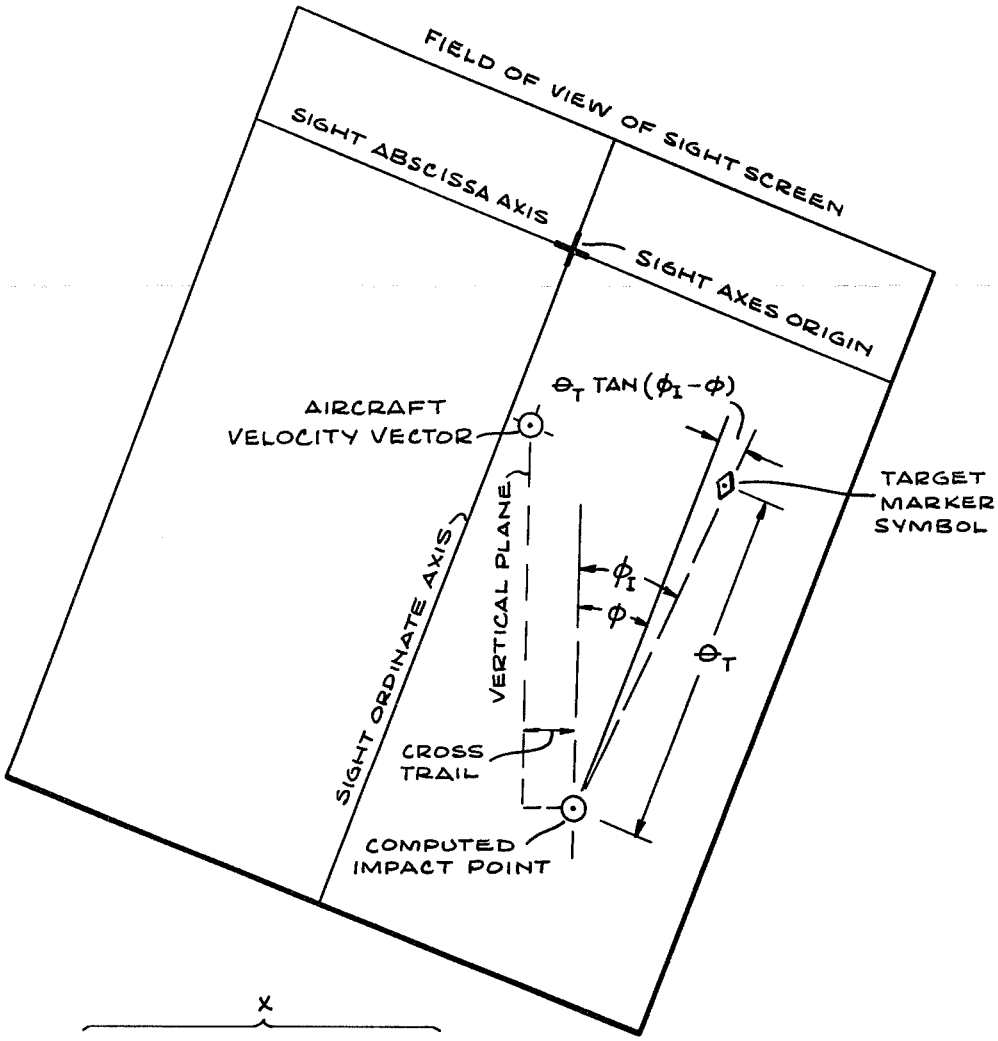
FIG. 3 is a view of a typical heads-up display under roll condition.

FIG. 3 illustrates how the sight might look while designating the target or pickling in a 20 degree bank to the right in a 20 degree dive at 400 kt from an altitude of 610 m above ground level. The sight screen is shown rolled 20 degrees to the right. The computed impact point is shown displaced slightly to the right of the ground track plane to represent the cross trail effect of a left to right crosswind.

Figure 4:
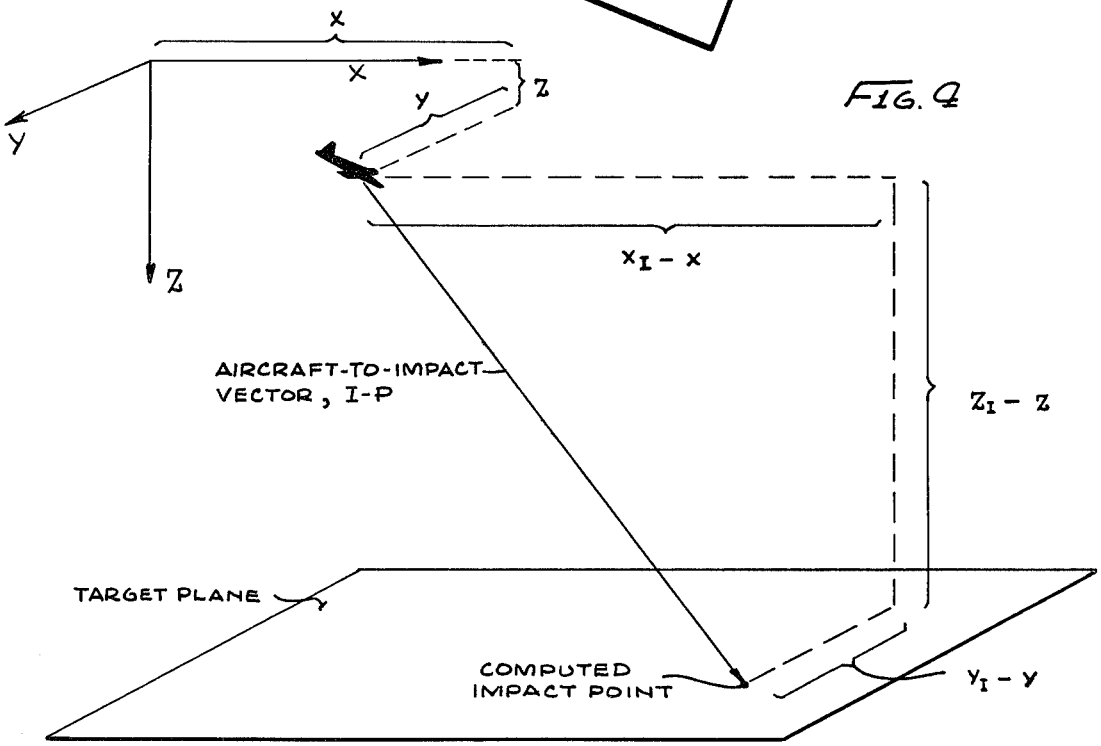
FIG. 4 is a diagram showing the relation between altitude, aircraft position and impact point.

To complete the derivation of equations for the continuously computed release point mode of operation, first establish the direction of the vector connecting the aircraft and the impact point, illustrated schematically in FIG. 4. The impact prediction equations are $$\left.\begin{aligned} X_I &= X + t_f V_x - T_R\cos\delta \\ Y_I &= Y + t_f V_y - T_R\sin\delta \\ Z_I &= H_A - H_T \end{aligned}\right\} \tag{15}$$

where $X_I$, $Y_I$, $Z_I$ are the components of the impact point in earth-fixed coordinates, X, Y, Z are the components of aircraft position in earth-fixed coordinates, $V_X$, $V_Y$ are the components of aircraft ground velocity, $t_f$ and $T_R$ are the time-of-fall and trail of the weapon, $\delta$ is the drift angle between the X-axis and the horizontal component of the weapon's airspeed vector at computed release, and $H_A$ and $H_T$ are the aircraft and target altitudes.

The next step is to transform the aircraft-to-impact vector from earth-fixed coordinates into aircraft coordinates $X_A$, $Y_A$, $Z_A$ through the transformation [T].

$$\begin{bmatrix} (X_I - X)_{XA} \\ (Y_I - Y)_{YA} \\ (Z_I - Z)_{ZA} \end{bmatrix} = [T]\begin{bmatrix} X_I - X \\ Y_I - Y \\ Z_I - Z \end{bmatrix} \tag{16}$$

where $$[T] = \begin{bmatrix} \cos\psi\cos\theta & \sin\psi\cos\theta & -\sin\theta \\ (-\sin\psi\cos\phi + \cos\psi\sin\theta\sin\phi) & (\cos\psi\cos\phi + \sin\psi\sin\theta\sin\phi) & \cos\theta\sin\phi \\ (\sin\psi\sin\phi + \cos\psi\sin\theta\cos\phi) & (-\cos\psi\sin\psi + \sin\psi\sin\theta\cos\phi) & \cos\theta\cos\phi \end{bmatrix} \tag{17}$$

From the computed impact point, displace the target marker symbol up the sight (parallel to the sight ordinate axis) by an amount $\theta_T$ (to be determined shortly) and to the right (parallel to the sight abscissa axis) by an amount $\theta_T$ tan ($\phi_I$-$\phi$). This places the target marker symbol approximately in line with the track of the computed impact point if the pilot pulls straight back on the stick without unrolling. (See FIG. 3)

The choice of $\theta_T$ is somewhat arbitrary, because it, together with the magnitude of the pullup acceleration, merely determines the time between target designation and release. Most pilots prefer to make this time as short as possible so that they can get rid of the bomb and begin their evasive escape maneuver as soon as possible. However, it still has to be long enough to allow time for making at least small steering corrections.

The only absolutely necessary constraints on $\theta_T$ are that it be neither negative nor so large as to point the target designating pipper at or above the horizon. If $\theta_T$ were negative, the release point would already be passed when the pilot designates the target. If the pipper is above the horizon, the pilot cannot place the pipper on the target. One way to ensure that the pipper always leads the computed impact point and still is directed toward the ground is to compute $\theta_T$ according to the expression derived in connection with FIG. 5. That is, $$\tan\theta_T = \frac{\left(\frac{V_x t_{PR}}{R_B}\right)\left(\frac{Z}{R_B}\right)}{1 + \left(\frac{Z}{R_B}\right)^2 + \frac{V_x t_{PR}}{R_B}} \tag{18}$$

where $\theta_T$ is the angle between the line of sight to the continuously computed impact point and the line-of-sight through the target marker symbol at or before target designation.

$V_x$ is the continuously computed down track component of weapon velocity at any time until release (ground speed).

$t_{PR}$ is a parameter nominally equal to 2.5 sec. for dive-toss and level laydown bomb deliveries.

Z is the continuously computed altitude of the weapon above the target until release.

$R_B$ is the ballistic range of the weapon.

Note from FIG. 5 that $$\frac{Z}{R_B + V_x t_{PR}} = \tan(\theta - \theta_T) = \frac{\tan\theta - \tan\theta_T}{1 + \tan\theta \tan\theta_T} \quad (19)$$

where $\theta$ is the angle between the horizontal plane and the line-of-sight to the computed impact point.

$$(1 + \tan\theta \tan\theta_T)\frac{Z}{R_B + V_x t_{PR}} = \tan\theta - \tan\theta_T \quad (20)$$

$$\left(1 + \frac{Z \tan\theta}{R_B + V_x t_{PR}}\right) \tan\theta_T = \tan\theta - \frac{Z}{R_B + V_x t_{PR}} \quad (21)$$

$$\tan\theta_T = \frac{\frac{Z}{R_B} - \frac{Z}{R_B + V_x t_{PR}}}{1 + \left(\frac{Z}{R_B}\right)\left(\frac{Z}{R_B + V_x t_{PR}}\right)} = \frac{V_x t_{PR} Z}{R_B^2 + Z^2 + R_B V_x t_{PR}} \quad (22)$$

$$\tan\theta_T = \frac{\left(\frac{V_x t_{PR}}{R_B}\right)\left(\frac{Z}{R_B}\right)}{1 + \left(\frac{Z}{R_B}\right)^2 + \frac{V_x t_{PR}}{R_B}} \quad (18)$$

This value for $\theta_T$ succeeds in pointing the target designating symbol at a point on the ground which is beyond the impact point by an amount approximately equal to $V_x t_{PR}$. The parameter $t_{PR}$ represents the time interval between target designation and release for an aircraft in straight and level flight. Selection of a value for $t_{PR}$ which is between 1 and 4 seconds should result in an operationally acceptable time between target designation and release.

For example, compute $\theta_T$ from Equation (18) for the following typical set of CCRP target designation conditions.

| | | |
|---|---|---|
| Dive Angle | 30 deg | $(V_x = 231.5$ m/s) |
| True Air Speed | 450 Kts | |
| Altitude, $Z$ | 1117 m | $(\theta = 37.65$ deg) |
| Bomb Range, $R_B$ | 1448 m | |

For a value of $t_{PR}=2.5$ sec, we compute the following value of $\theta_T$ for this case.

$$\left.\begin{aligned} \tan\theta_T &= \frac{\left(\frac{231.5 \frac{\text{m}}{\text{sec}} \times 2.5 \text{ sec}}{1448 \text{ m}}\right)\left(\frac{1117 \text{ m}}{1448 \text{ m}}\right)}{1 + \left(\frac{1117}{1448}\right)^2 + \frac{231.5 \times 2.5}{1448}} = 0.1546 \\ \theta_T &= 153.4 \text{ milliradians} = 8.79 \text{ degrees} \end{aligned}\right\} \quad (23)$$

Note that use of the parametric value of 2.5 sec for $t_{PR}$ yields a pipper placement which is 1.14 degrees ($\theta - \theta_T = 28.86$ deg) above the flight path angle ($\gamma = 30$ deg). This is between the two popular pipper placement schemes which place the target market (1) in the pitch plane of the velocity vector or (2) on the aircraft boresight.

The parameter $t_{PR}$ in Equation (18) provides a degree of software control over the characteristic time between target designation and release in the dive-toss mode. It can be adjusted to suit pilot preference.

Equations (14) and (18) are the mechanization equations which satisfy the stated purpose of placing the target designating symbol (see FIG. 3) in such a position that, after designating the target, the pilot can pull straight back on the stick without first unrolling to a wings level attitude.

The foregoing derivation of the target pipper placement equations depended on two approximations. The first is that pipper motion during pullup is independent of bomb drag. The second is that the pipper moves in a straight line during a coordinated, turning pullup.

The zero bomb drag approximation really introduces no new pipper placement errors beyond those already present in current pipper placement schemes. The cross trail actually does change during the pullup in both the current schemes and in the scheme proposed herein, and the pilot must compensate for this variation by making a small steering correction during the pullup maneuver in either case. The new scheme is no worse than the present ones in this respect.

The second assumption, namely that the impact point moves in a straight line during the pullup will be valid to the extent that F, the denominator of Equation (10), remains constant during the pullup. Of course, F does change during the pullup as the altitude and dive angle of the aircraft change. This alters the slope of the path of the impact point in the sight or Heads-up display causing the impact point to move in a curved instead of in a straight line path.

To estimate the magnitude of this slope change, calculate the value of F both at target designation and again at release during a typical dive-toss delivery. The following statements summarize the target designation and release conditions.

| | |
|---|---|
| Target designation | 450 kt speed, 1000 m altitude, 30 deg dive |
| Release | 450 kt speed, 863 m altitude, 19.7 deg dive |

Using the figures from the above example to calculate F as in FIG. 2, $$F = \sin\theta \cos\gamma (\tan\gamma + \text{ctn } \gamma_I) = \begin{cases} 0.867 \text{ at target designation} \\ 0.788 \text{ at release} \end{cases} \quad (24)$$

The corresponding values of tan ($\phi_I$-$\phi$) for a 20 degree roll are, from Equation (13)

$$\tan(\phi_I - 20 \text{ deg}) = \begin{cases} 0.0484 \text{ at target designation} \\ 0.0838 \text{ at release} \end{cases} \quad (25)$$

The maximum change in slope from target designation to release is 0.0354 radians in this example. The mean change in slope is 0.0177 radians. This will multiply by the angular difference, $\theta_T$, between the impact point and the target designating symbol at target designation time to cause a lateral pipper placement error. Once again, this is not necessarily a bombing error because the pilot can still compensate for it by nulling the steering signal during pullup. Consider how big a compensatory steering correction he has to make.

The magnitude of $\theta_T$, if computed according to Equation (17) with $t_{PR}=2.5$ sec and with the foregoing conditions at target designation, is 171 milliradians. This angle when multiplied by the mean change in slope between target designation and release would result in a lateral pipper placement error of about 3 milliradians. It can be concluded from this example that the straight line impact point motion assumption results in an acceptably small if not negligible steering error signal.

In summary, the pilot steering corrections needed to compensate for pipper placement errors caused by the zero bomb drag and straight line impact path assumptions are no larger than those steering corrections needed in the current pipper placement schemes.

As mentioned above, the pipper placement scheme of this invention gives the pilot a positive, direct azimuthal control over the pipper position, contrary to the currently operational pipper placement mechanizations which are keyed to the aircraft velocity vector. To change the azimuth orientation of a drift stabilized pipper, the pilot has to change the azimuth direction of the aircraft's velocity vector. This is an integration process with an inherent time lag. The pilot first has to roll the aircraft toward the direction in which he wants to move the pipper and pull back on the control stick. The pipper then gradually moves toward the desired azimuth.

In contrast, with the mechanization of the invention, the pipper immediately rotates about the computed impact point on a lever arm equal to $\theta_T$ as the pilot rolls the aircraft (see FIG. 3). The angle of rotation, $\phi_I$, of the pipper is slightly greater than the roll angle, $\phi$, itself. The pipper is stabilized against pitching and yawing motion, because (except for the small cross trail term and ejection velocity direction corrections in the impact point computation), $\theta_T$, tan $(\phi_I-\phi)$, and the computed impact point are all independent of the pitch and yaw attitude of the aircraft. However, the pilot can make a last second azimuth adjustment to place the pipper over the target simply by changing the roll angle of the aircraft.

The sensitivity of this pipper response to roll control action is proportional to the lever arm, $\theta_T$. By increasing or decreasing $\theta_T$, (through variation of the parameter $t_{PR}$) one can adjust the pipper roll sensitivity to match the amount desired by the pilots.

A primary objective of this invention is to devise a pipper placement scheme for dive-toss weapon deliveries which does not require the pilot, after designating the target, to unroll into a wings level attitude before pulling up to release. However, upon reviewing the resulting mechanization, one sees that it can be generalized to include continuously computed impact point (CCIP) and level laydown weapon deliveries as well. Traditional weapon delivery systems treat these as separate modes. Combining them essentially into a single mode would both simplify the software and decrease the number of mode selection decisions and actions imposed on the pilot.

A glance at FIG. 3 shows that if $\theta_T$ equals zero, we have a CCIP weapon delivery mode. Hence, one can view the parameter $t_{PR}$ in Equation (18) as providing a continuum of weapon delivery modes with CCIP being one extreme, namely $t_{PR}=0$. The same software that is used for the dive-toss mode could also provide the CCIP mode simply by setting $t_{PR}=0$.

The level laydown mode is also akin to the dive-toss mode in that it requires the target designating symbol to be above the currently computed impact point by some amount $\theta_T$. The chief difference is that $\theta_T$ must also be less than the angular distance between the line-of-sight to the impact point and the aircraft velocity vector, because with the aircraft in level flight, the velocity vector is already above the target. The second difference is that the level laydown delivery uses high drag bombs instead of low drag bombs.

Equation (18) for $\theta_T$ satisfies all of the above conditions. Its derivation (FIG. 5) is applicable to both high and low drag bombs, and it directs the target designating symbol toward a point on the ground which is beyond the impact point. In fact, in level laydown the time between target designation and release is exactly equal to $t_{PR}$.

Typically the required calculations would be made in a digital data processor. It might be a special processor specifically designed to make the required calculations, or it might be a general processor which is programmed to make the required computations.

Alternatively, the computer could be an analog computer.

Sensors may generate either digital or analog outputs. Digital-analog, analog-digital converters can be used to put the raw signal into the proper format.

FIG. 6 is a block diagram of a computer, either digital or analog, which performs the required operations. It is understood that the signals are in the proper digital or analog format.

Air density is a known function of air temperature and static air pressure. True air speed of an aircraft is a known function of both ram and static barometric pressure and of static air temperature. The air density computer 10 computes both air density, $\rho$, and true air speed, TAS.

The ballistic computer 12 computes the range $R_B$ of the bomb, the flight angle of the bomb at impact, the trail of the bomb, and the time of flight of the bomb as a known function of air density, true air speed, air temperature, the ratio of bomb drag coefficient, $C_D$ times bomb cross sectional area A to bomb mass M, the acceleration of gravity g, the aircraft altitude Z relative to the target and the aircraft velocity $V_x$, $V_y$.

A typical ballistic computer is described in Naval Weapons Center report NWC-TP-5416 (unclassified), published in September, 1972 by Arthur A. Duke, et al., entitled, "A Ballistic Trajectory Algorithm for Digital Airborne Fire Control."

An inertial autonavigator 18 uses typically a gimballed stabilized platform carrying two or three accelerometers and two or three gyroscopes. Closed servo loops from the outputs of the gyroscopes and accelerometers stabilize the platform to a locally level position, and the accelerometers generate signals which are used to generate velocity and position signals. An update means, for example, a radar altimeter or the target computer 34 produces signals which are a measure of the height of the aircraft, $Z_T$, above the target, and the coordinates of the target relative to the aircraft at the time of pickling the target. Computer means associated with the inertial navigator 18 uses the $X_T$, $Y_T$ and signals from the autonavigator to initialize or update continual X, Y, Z signals of the position of the aircraft relative to the target. Signals which are measures of the roll angle, $\phi$, aircraft heading $\psi$ and aircraft pitch $\theta$ may be obtained from resolvers on the gimbal axes of the autonavigator 18.

The signals from the autonavigator 18 are distributed as follows. $\dot{Z}$ signal goes to the ballistic computer 12 and the F computer 20. The $V_x$, $V_y$ signals go to the ballistic computer 12. $V_x$ and $V_y$ also go to the impact computer 24 along with X and Y. The Z signal goes to the F computer 20 and the $\theta_T$ computer 14. The $\phi$ signal goes to the sight cross axis computer. The $\delta$ signal goes to the impact computer 24. All three attitude signals—$\phi,\theta$, and $\psi$—go to the coordinate transformation resolver 26.

In addition to receiving $V_x$, $V_y$, X, Y and $\delta$ signals, the impact computer receives $T_R$ and $t_f$ signals which are the time of fall and trail of the bomb from the ballistic computer 12.

The $X_I$, $Y_I$ positions of the impact point are computed by the impact computer 24, and $X_I$, $Y_I$ signals are delivered to the steering and release computer, to the coordinate transformation 26 which transforms the impact point coordinate signals into sight coordinates, and to the inertial autonavigator 18.

The F computer computes the signal F in response to the Z and $\dot{Z}$ signals, the ground speed signal, the bomb range signal, $R_B$ and the flight path angle $\gamma_I$ signal of the weapon from the ballistic computer 12. Note from FIG. 4 the relation between Z, $\dot{Z}$ and $\gamma$.

The $\theta_T$ computer 14 computes $\theta_T$ in response to Z, $R_B$ and $t_{PR}$ signals. $R_B$ is the ballistic range of the bomb signal from computer 12, the Z signal is from the autonavigator, and the $t_{PR}$ is known. The constant $t_{PR}$ is the time from target designation to release if the pilot does not pull up until after bomb release.

The sight cross axis computer, in response to $\theta_T$, and F computes a portion $\theta_T \tan(\phi_I-\phi)$ of the cross axis placement of the pipper which is added to the azimuth of the impact point to displace the pipper on its cross axis.

The pipper is displaced on its vertical axis by an amount $\theta_T$ plus the elevation of the point of impact.

The pipper vertical and cross axis displacement signals are delivered not only to the pipper display but also to the target computer 34.

The target computer 34 delivers coordinate position $X_T$, $Y_T$ of the aircraft in earth coordinates with respect to the target at the time of pickling the target, in response to pipper placement, slant range to target, barometric altitudes of the target and aircraft.

Steering signals to the aircraft and release signals for the bomb are generated by the steering and release computer 32 in response to $X_I$, $Y_I$ the computed coordinates of the point of impact of the bomb. When $X_I$, $Y_I$ are zero the bomb is released. In the event $X_I$ and $Y_I$ do not go to zero simultaneously, the bomb is released when $X_I^2+Y_I^2$ is smallest.

After target designation, steering signals from steering and release computer 32, proportional to the cross product of impact point velocity and impact point position relative to the target are provided to the pilot in a display (not shown). The pilot steers the aircraft to maintain a null steering signal.

The impact computer 24 mechanizes equation (14). The target computer changes the target coordinates from aircraft to earth coordinates at the time of pickling or designating the target.

The pilot of the aircraft flies the aircraft toward the target to place the pipper on the target. As the pipper approaches the target, he trims the pipper right or left by rolling the aircraft right or left. As the pipper crosses the target, the pilot pickles or designates the target and immediately starts his pull up by pulling the stick straight back. Final corrections can be made by the pilot after pickling by following the steering signals.

Thus the apparatus of this invention is useful in delivering a bomb to a target, particularly in a toss bombing mode, wherein the pilot makes last minute trim of the target pipper or designator by rolling the aeroplane then pulling straight back on the control stick without coming out of the roll.

Although the invention has been described in detail above, it is not intended that the invention shall be limited by that specific described embodiment, but only in accord with the spirit and scope of the claims.

I claim:

1. In an aircraft having a bombing system, means for assisting the pilot to control a bomb to drop it on a target, comprising:

(1) air density computer means for producing signals which are a measure of air density $\rho$ and true air speed in response to barometric air pressure, ram air pressure, and temperature signals;

(2) means for producing signals which are measures of vertical and horizontal velocity component signals $\dot{Z}$, $V_x$, $V_y$ of the aircraft and vertical and horizontal components of the aircraft's position, x, y, z relative to the target, $\theta$, $\phi$, $\psi$ and $\delta$, including means responsive to $X_T$, $Y_T$ signals which are measures of earth coordinates of the target relative to the aircraft position at time of target designation;

(3) ballistic computer means for producing signals which are a measure of $R_B$, $t_f$, $T_R$, and $\gamma_I$ in response to Z, $V_y$, $V_x$, $C_DA/M$ and g signals;

(4) F computer means for producing a signal which is a measure of F in response to $R_B$, Z, $\dot{Z}$, $\gamma_I$ and ground speed signals;

(5) a sight cross-axis computer means for producing a signal which is a measure of $\theta_T \tan(\phi_I-\phi)$ in response to F, $\phi$ and $\theta_T$ signals;

(6) impact computer means for producing signals which are measures of the $X_I$ and $Y_I$ coordinates of the impact point relative to the target in response to $V_x$, $V_y$, $\delta$, x, y, $t_f$ and $T_R$ signals;

(7) first resolver means responsive to $\phi$, $\psi$ and $\theta$ signals for transforming $X_I$ and $Y_I$ into pipper azimuth and elevation signals;

(8) means for adding said $\theta_T \tan(\phi_I-\phi)$ signalto said pipper azimuth signal to produce a pipper cross-axis placement signal;

(9) means for adding a $\theta_T$ signal to said pipper elevation signal to produce a pipper vertical placement signal;

(10) second resolver means responsive to $\theta$, $\psi$, $\phi$, baro-altitude of aircraft, target baro-altitude, said pipper cross axis placement and pipper vertical placement signals to produce said $X_T$, $Y_T$, $Z_T$ signals; and

(11) means for producing a signal to release a bomb when $X_I^2+Y_I^2$ is minimum.

2. Apparatus as recited in claim 1 and further comprising means for producing a steering signal in response to $X_I$, $Y_I$ signals subsequent to target designation to guide the pilot until bomb release.

3. Apparatus as recited in claim 1 in which said second resolver means is further responsive to signals which are measures of slant range from the aircraft to the target.

4. Apparatus as recited in claim 1 and further comprising $\theta_T$ computer means for computing a signal for $\theta_T$ in response to ground speed, $R_B$, Z and $t_{PR}$.

* * * * *

UNITED STATES PATENT AND TRADEMARK OFFICE

CERTIFICATE OF CORRECTION

PATENT NO. : 4,215,621

DATED : August 5, 1980

INVENTOR(S) : John S. Ausman

It is certified that error appears in the above—identified patent and that said Letters Patent is hereby corrected as shown below:

Col. 12, Line 27 Change "Z" to ---Ż---.

Signed and Sealed this

Fifth Day of October 1982

[SEAL]

*Attest:*

GERALD J. MOSSINGHOFF

*Attesting Officer* *Commissioner of Patents and Trademarks*